United States Patent [19]

Aoyoma et al.

[11] Patent Number: 4,516,542

[45] Date of Patent: May 14, 1985

[54] VALVE OPERATION CHANGING SYSTEM OF INTERNAL COMBUSTION ENGINE

[75] Inventors: Shunichi Aoyoma, Yokosuka; Manabu Kato, Tokyo, both of Japan

[73] Assignee: Nissan Motor Co., Ltd., Yokohama, Japan

[21] Appl. No.: 499,465

[22] Filed: May 31, 1983

[30] Foreign Application Priority Data

Jun. 2, 1982 [JP] Japan ..... 57-94378
Jul. 27, 1982 [JP] Japan ..... 57-113690[U]
Jan. 12, 1983 [JP] Japan ..... 58-2326[U]

[51] Int. Cl.[3] ..... F01L 1/34

[52] U.S. Cl. ..... 123/90.16; 123/90.44; 123/198 F

[58] Field of Search ..... 123/90.16, 198 F, 90.39, 123/90.27, 90.44

[56] References Cited

U.S. PATENT DOCUMENTS 3,878,822 4/1975 Beal ..... 123/90.16
4,151,817 5/1979 Mueller ..... 123/90.16
4,182,289 1/1980 Nakajima et al. ..... 123/90.16
4,354,460 10/1982 Mae et al. ..... 123/90.16

*Primary Examiner*—William R. Cline
*Assistant Examiner*—Peggy A. Neils
*Attorney, Agent, or Firm*—Schwartz, Jeffery, Schwaab, Mack, Blumenthal & Koch

[57] ABSTRACT

A valve operation changing system of an internal combustion engine comprises first and second cams formed on a camshaft. The first and second cams are different in cam profile from each other. At least one of the cams has a plurality of cam faces which are axially separate from each other. Additionally, a rocker arm is provided with a follower section contactable with the cam face of the first and second cams. The follower section has a plurality of contact faces at least one of which is contactable with the cam face of the first cam when the rocker arm is in a first position, while with the cam face of the second cam when the rocker arm is in a second position, thereby reducing the moving distance of the rocker arm to improve the response in valve timing change of an engine valve.

19 Claims, 19 Drawing Figures

VALVE OPERATION CHANGING SYSTEM OF INTERNAL COMBUSTION ENGINE

BACKGROUND OF THE INVENTION

1. Field of the Invention

This invention relates to an improvement in a valve operation changing system for changing the valve timings of an intake or exhaust valve of an internal combustion engine in accordance with engine operating conditions.

2. Description of the Prior Art

Valve operation changing systems have been applied to various uses in the field of internal combustion engines. For example, a valve operation changing system is used in a dual-mode engine which is so arranged that the valve timing of the intake and exhaust valve is changed at a light load engine operating range so as to deactivate some cylinders, thereby carrying out a part-load engine operation.

In general, a gasoline engine of the type wherein charge is previously prepared by mixing air and fuel has a tendency that good fuel economy is obtained at a high engine load operating range. In this regard, in the dual-mode engine, the intake and exhaust valves of some cylinders are kept fully closed to interrupt the supply of air and fuel thereinto thereby to de-activate the cylinders. This relatively increases engine load applied to the remaining cylinders, thereby improving fuel economy of the engine at the light load engine operating range.

The valve timing changing of the intake and exhaust valves of the dual-mode engine is usually carried out by transferring rocker arms from a first cam for cylinder activation or working onto a second cam for cylinder deactivation or rest in accordance with the engine operating conditions. The first and second cams are formed on a single camshaft and located side by side.

In order to thus transfer the rocker arms, the rocker arm axial moving distance must be longer than the width of each cam. Accordingly, it is required that an actuator device for driving the rocker arms have a longer moving stroke and a larger driving force for the purpose of achieving smooth and reliable transfer of the rocker arms.

SUMMARY OF THE INVENTION

A valve operation changing system according to the present invention comprises first and second cams formed on a camshaft. The first and second cams are different in cam profile from each other. At least one of the cams has a plurality of cam faces which are separate from each other. Additionally, a rocker arm is mounted on a rocker shaft and swingable relative to the rocker shaft so as to operate an engine valve. The rocker arm is also movable in the axial direction of said rocker shaft and formed with a follower section which is contactable with the cam face of the first and second cams. The follower section has a plurality of contact faces at least one of which is contactable with the cam face of the first cam when the rocker arm is put in a first position, while with the cam face of the second cam when the rocker arm is put in a second position. Such position change of the rocker arm takes place in accordance with an engine operating condition.

With the thus arranged system, the moving distance of the rocker arm required for rocker arm transferal from the first cam onto the second cam is sharply reduced, and therefore a greater force is not necessary for moving the rocker arm while improving the response in valve timing changing of the engine valve.

BRIEF DESCRIPTION OF THE DRAWINGS

The features and advantages of the valve operating changing system according to the present invention will be more clearly appreciated from the following description taken in conjunction with the accompanying drawings in which like reference numerals designate like parts and elements throughout all the embodiments of the present invention, and in which.

DETAILED DESCRIPTION OF THE INVENTION

Figure 1:
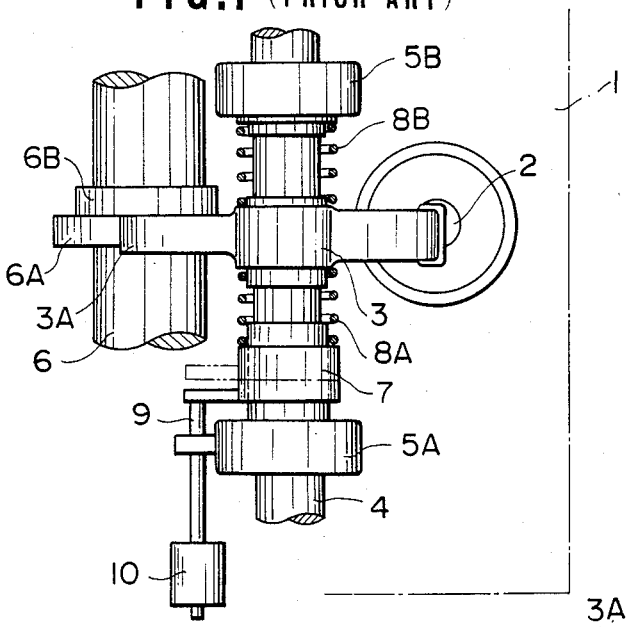
FIG.1 (PRIOR ART)
FIG. 1 is a plan view of a conventional valve operation changing system.
Figure 2:
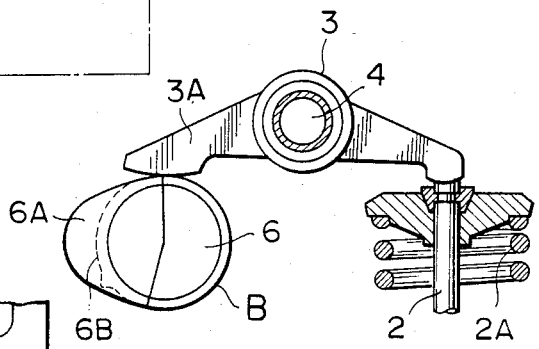
FIG.2 (PRIOR ART)
FIG. 2 is a front elevation of the system of FIG. 1.
Figure 3:
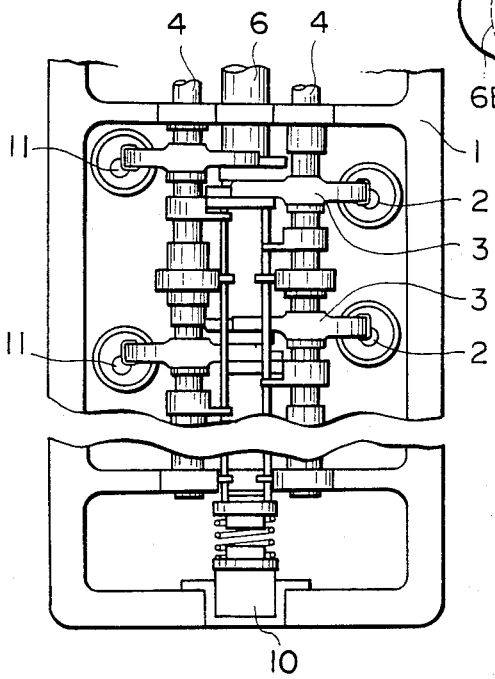
FIG.3 (PRIOR ART)
FIG. 3 is a plan view of an essential part of a dual-mode engine equipped with the conventional valve operation changing system of FIG. 1.

To facilitate understanding the present invention, a brief reference will be made to a conventional valve operation changing system of a dual-mode internal combustion engine, depicted in FIGS. 1 to 3. Referring to FIGS. 1 to 3, a cylinder head 1 is provided with an intake valve 2 in cooperation with a cylinder (not shown). A rocker arm 3 is rotatably mounted on a rocker shaft 4. The rocker shaft 4 is rotatably supported through brackets 5A, 5B by the cylinder head 1. The reference numeral 6 denotes a camshaft.

The camshaft 6 is formed with first and second cams 6A, 6B located side by side. The first cam 6A has a cam profile for opening the intake valve 2 through the rocker arm 3 in a manner indicated in FIG. 4A at the intake stroke during the working or activation of the cylinder, under the cooperation of a valve spring 2A shown in FIG. 2. The second cam 6B has a cam profile for opening the intake valve 2 through the rocker arm 3 only in a manner indicated in FIG. 4B at the terminal stage (at the piston location in the vicinity of bottom dead center) of intake stroke during the rest or deactivation of the cylinder. In this case, the cylinder is arranged to put into the rest or deactivated condition when the engine is operated at a light load engine operating range. The rocker arm 3 is swingable relative to the rocker shaft 4, and elastically supported between the brackets 5A, 5B under the action of first and second springs 8A, 8B so as to be movable in the axial direction of the rocker shaft 4, i.e., in the upward and downward direction in the drawing. More specifically, a changing ring 7 for changing the location of the rocker arm 3 is slidably mounted on the rocker shaft 4 and arranged to be slidable in the axial direction of the rocker shaft 4 between the rocker arm 3 and the bracket 5A. Accordingly, locating the changing ring 7 is achieved under the balance of tension between the first spring 8A and the second spring 8B. The first spring 8A is located between the changing ring 7 and the rocker arm 3, while the second spring 8B is located between the bracket 5B and the rocker arm 3.

Figure 4A:
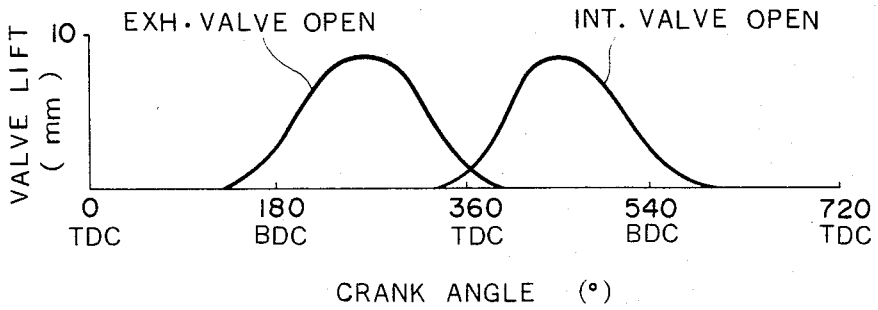
FIG. 4A is a graphical representation showing the valve timings of intake and exhaust valves during cylinder activating or working.

The changing ring 7 is actuated through a rod 9 by an actuator 10 which includes a solenoid or hydraulic cylinder. The actuator 10 in this case is adapted to move the changing ring 7 into a location indicated in phantom in FIG. 1 in order to cause the rocker arm 3 to contact with the second cam 6B. Thus, during the working of the cylinder, the changing ring 7 is arranged to locate the rocker arm 3 on the first cam 6A so as to open or close the intake valve 2 in accordance with the cam profile of the first cam 6A as shown in FIG. 4A. From this state, when the changing ring 7 is moved toward the bracket 5B under the driving force of the actuator 10, the springs 8A, 8B are compressed to push the rocker arm 3 so that the rocker arm 3 moves onto the second cam 6B during the time period at which a follower section 3A of the rocker arm 3 resides in the base circle area B of the cam profile of the cam 6A. In this state, the intake valve 2 opens a slight time period at the terminal stage (at the piston location of bottom dead center) of intake stroke in accordance with the cam profile of the second cam 6B as shown in FIG. 4B.

A similar valve operation changing system is provided also for an exhaust valve 11, so that the exhaust valve 11 opens at exhaust stroke during the working of the cylinder in a manner indicated in FIG. 4A, whereas closes during the rest of the cylinder.

Thus, when the actuator 10 is operated at the light load engine operating range, the intake and exhaust actions of cylinders at rest are regulated, thereby preventing the cylinders at rest from being supplied with air-fuel mixture. Accordingly, combustion does not take place in the cylinders at rest, and simultaneously the air-air mixture not supplied to the cylinders is inducted into working cylinders, thus relatively increasing the load applied to the working cylinders. As a result, good fuel economy characteristics can totally be obtained preventing a decrease in engine power output.

Figure 4B:
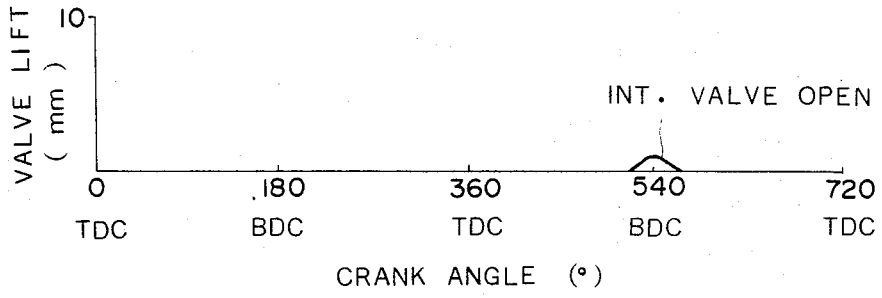
FIG. 4B is a graphical representation showing the valve timing of the intake valve during cylinder deactivation or rest.

It will be understood that the reason why the intake valve 2 of the cylinder at rest is slightly opened as shown in FIG. 4B is that an increase in difference between the torques generated at the rest cylinders and the working cylinders is prevented by supplying gas into the rest cylinders thereby to increase compression work in the same cylinders.

Now, as discussed above, the rocker arm 3 is driven by the actuator 10 to move in the axial direction of the rocker shaft 4 so as to be brought into contact with the respective cams 6A, 6B, thereby changing the valve timing of the intake or exhaust valve. Therefore, it will be understood that the amount of movement of the rocker arm follower section 3A in the rocker shaft axial direction is more than the width of each cam 6A, 6B. In this regard, it is required to accomplish quickly and certainly the movement of the rocker arm follower section 3A in the axial direction of the rocker shaft. For this purpose, the actuator 10 must be so constructed as to provide a longer actuation stroke and a greater driving force.

Figure 5:
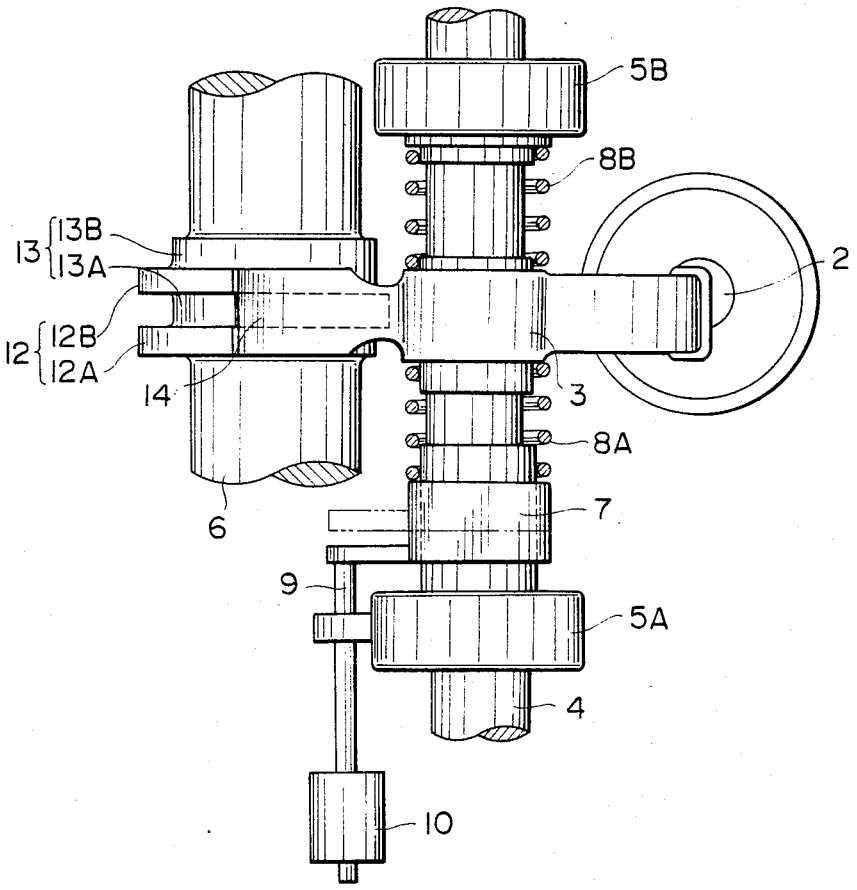
FIG. 5 is a plan view of a first embodiment of a valve operation changing system in accordance with the present invention.
Figure 6:
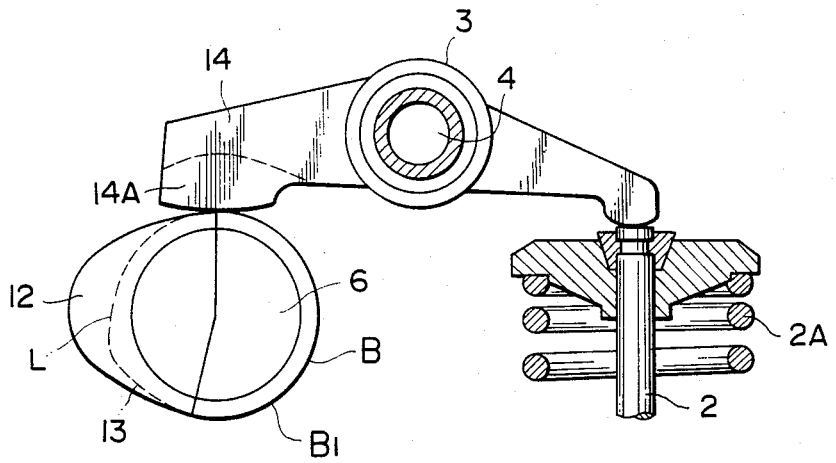
FIG. 6 is a front elevation of the system of FIG. 5.
Figure 7:
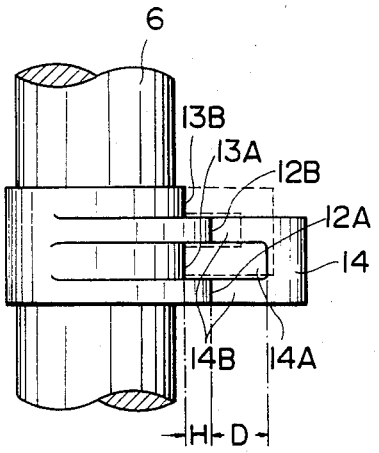
FIG. 7 is an illustration showing an essential part of the system of FIG. 5 in which cams are in contact with the follower section of a rocker arm.

In view of the above description of the conventional valve operation changing system, reference is now made to FIGS. 5 to 7 wherein a first embodiment of a valve operation changing system of an internal combustion engine, according to the present invention is illustrated. In FIGS. 5 to 7, the same reference numerals as in FIGS. 1 to 3 designate the same parts and elements for the purpose of simplicity of illustration.

A camshaft 6 is formed with two cams 12, 13. The cam 12 is divided into two narrower cams 12A, 12B in a plane to which the axis of the camshaft is perpendicular, which cams 12A, 12B have respective cam faces (no numerals) which are the same with each other in cam profile or contour. The cam 13 is likewise formed to have two narrower cams 13A, 13B having the same cam profile. The cam profile of the cam 12 corresponds to that of the cam 6A in FIG. 1, while the cam profile of the cam 13 corresponds to that of the cam 6B in FIG. 1. As shown, the narrower cam of the cam 12 and the narrower cam of the cam 13 are alternately located, i.e., located side by side so that the narrower cams 12A, 12B (13A, 13B) are separate from each other.

A rocker arm 3 rotatably mounted on a rocker shaft 4 is formed with a follower section 14 which has two contact portions 14B, 14B which are capable of being respectively in slidable contact with the narrower cams 12A, 12B (13A, 13B). The two contact portions 14B, 14B are formed parallel with each other leaving therebetween a cutout portion 14A whose depth D is larger than the maximum height H of the lift of the cam 12 as clearly shown in FIG. 7. The two contact portions 14B, 14B are approximately the same in width as the narrower cams 12A, 12B (13A, 13B), respectively. Thus, it will be understood that the cam face of each cam 12, 13 and the contact surface of the rocker arm follower section 14 are divided into the plural number.

The aforementioned cams 12 and 13 are produced as follows: Initially, a cam material having a width corresponding to total widths of the cams 12, 13 is prepared. The cam material is machined to simultaneously form the narrower cams 12A, 12B of the cam 12, and subsequently the narrower cams 13A, 13B of the cam 13 are formed by means of grinders whose widths correspond to those of the narrower cams 13A, 13B. Additionally, with regard to a cam having a smaller or lower valve lift area L as the cam 13, the valve lift area L is first formed and thereafter the other part is formed into the cylindrical shape whose diameter corresponds to the diameter of the base circle $B_1$ of the cam 13.

The operation of the thus arranged valve operation changing system will be discussed hereinafter.

In the state shown in FIG. 5, the contact portions 14B, 14B of the rocker arm follower section 14 are respectively in slidable contact with the narrower cams 12A, 12B, and accordingly the rocker arm 3 causes the intake valve 2 to operate in accordance with the cam profile of the cam 12. As a result, the intake and exhaust valves 2, 11 operate in the manner as shown in FIG. 4A, thereby allowing the cylinder to work.

From this state, when a changing ring 7 is moved toward the side of a bracket 5B under the action of the driving force of an actuator 10, springs 8A, 8B are compressed to push the rocker arm 3 so that the rocker arm 3 transfers from the cam 12 to the cam 13 during the time period at which the follower section 14 of the rocker arm 3 is in contact with the base circle area B of the cam 12. In this state, the contact portions 14B, 14B of the rocker arm follower section 14 are respectively in contact with the narrower cams 13A, 13B as indicated by broken lines in FIG. 7. At this time, the narrower cam 12B which does not contact with the follower section contact portion 14B passes through the cutout portion 14A. Hence, the rocker arm 3 causes the intake valve 2 to open a slight time duration in the manner shown in FIG. 4B at the terminal stage of intake stroke or at the piston location in the vicinity of bottom dead center, thereby putting the cylinder into the rest or deactivated condition.

Thus, although the total width of the cam faces of the narrower cams 12A, 12B (13A, 13B) of the cam 12 (13) is almost the same as that in the conventional case where the cam 12 and 13 are not divided as shown in FIGS. 1 to 3, the amount of movement of the rocker arm 3 in the axial direction of the rocker shaft 4 is approximately half that in the conventional case.

As will be appreciated from the above, according to the present invention, the cam face of each of two cams is divided into a plural number of surfaces, and the contact face of each of two contact portions of the rocker arm follower section is similarly divided into a corresponding number of surfaces. This renders a required movement amount of the rocker arm smaller, maintaining a sufficient width of the contacting faces of both the cam and the rocker arm follower section. Accordingly, changing the valve timing of the intake and the exhaust valve can be smoothly carried out, thereby providing a sufficient response in accordance with engine operation conditions. Furthermore, the driving force of the actuator to transfer the rocker arm becomes half that in the conventional case. This makes the actuator small-sized, giving an advantage from the viewpoint of engine layout. Moreover, such a smaller rocker arm movement amount makes small the amount of offset (distance) between the rocker arm axis and the valve stem axis as compared with the conventional case where the rocker arm movement amount is larger. This reduces the torsional moment applied to the rocker arm and the bending moment applied to the valve stem, thereby preventing the rocker arm, the valve stem and parts contacting them from eccentric or local wear.

Figure 8:
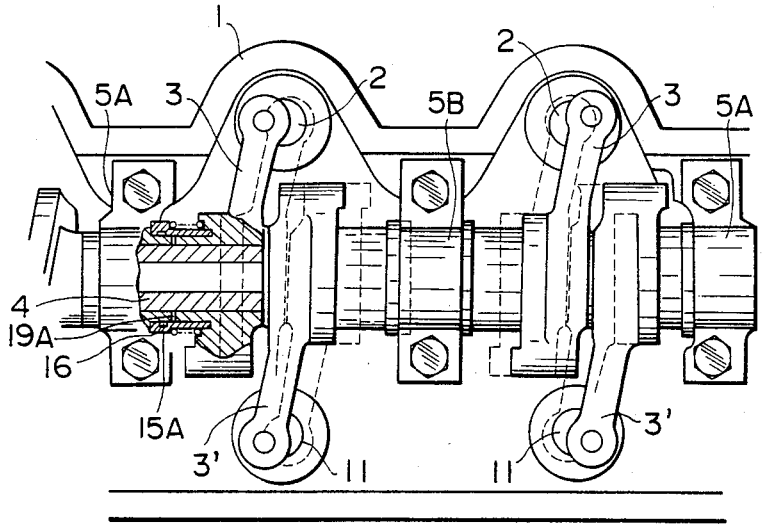
FIG. 8 is a plan view, partly in section, of an essential part of a second embodiment of the valve operation changing system in accordance with the present invention, mounted in a dual-mode engine at its upper part.
Figure 9:
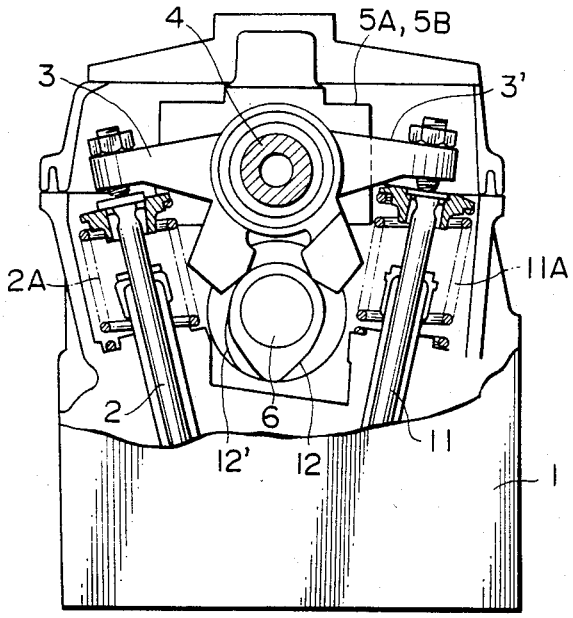
FIG. 9 is a front elevation, partly in section, of the upper part of the engine, showing the front elevation of the system of FIG. 8.
Figure 10:
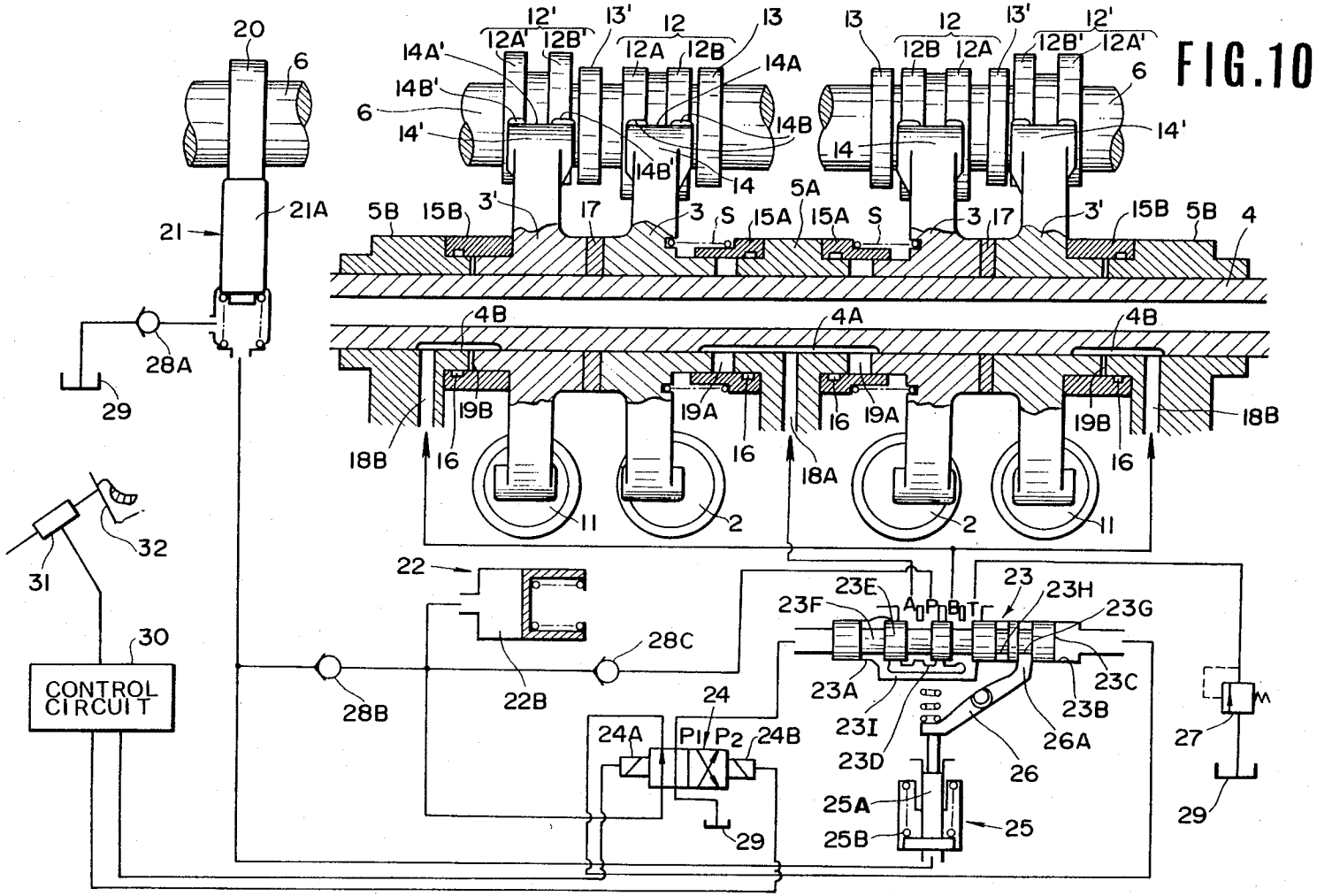
FIG. 10 is a diagram illustrating the system of FIG. 8.

FIGS. 8, 9 and 10 illustrate a second embodiment of the valve operation control system in accordance with the present invention, which system is used for an in-line four-cylinder internal combustion engine of the dual-mode type wherein two cylinders (cylinder Nos. 2 and 3) are capable of being deactivated or at rest (dead).

The camshaft 6 is formed with the cams 12, 13 for the intake valve 2, and the cams 12', 13' for the exhaust valve 11. These cams are disposed adjacent to each other, in which cam 12 and the cam 13 are located side by side. The intake and exhaust valves 2, 11 are operated to open and close in a manner as shown in FIG. 4A during the activation or working of the cylinders, through the rocker arms 3, 3' under the cooperation of the valve spring 2A and a valve spring 11A. During the deactivation or rest, the intake valve is operated to open and close in a manner as shown in FIG. 4B.

The rocker arms 3, 3' are not only swingable relative to the rocker shaft 4 but also slidable in the axial direction of the rocker shaft 4 between the brackets 5A, 5B. Accordingly, when a pressurized oil is introduced into a hydraulic pressure chamber 19A defined by the rocker shaft 4, the bracket 5A, a collar 15A and the rocker arm 3, the rocker arms 3, 3' move from a state (indicated by solid lines) to another state (indicated by broken lines) in FIG. 8, thereby changing the valve timing of the intake and exhaust valves 2, 11.

In FIG. 10, the valve operation changing system is illustrated in great detail, in which the camshaft 6 is shown to be located above the rocker shaft 4 and the intake and exhaust valves 2, 11 are shown to be located below the rocker shaft 4 in the drawing so that the camshaft 6 and the intake and exhaust valves 2, 11 are shown to be positioned approximately symmetrically with each other for reasons of convenience. Accordingly, their arrangement is slightly deformed relative to an actual model of the valve operation changing system in accordance with the present invention.

As shown, the cam 12 for the intake valve 2 and for cylinder activation is divided into two equal parts to form the narrower cams 12A, 12B. The cam 13 is formed equal in width to the narrower cam 12A, 12B. These cams are aligned side by side in the order of the narrower cam 12A, the narrower cam 12B, and the cam 13, leaving a clearance between the cams 12A and 12B which clearance is approximately the same in width as the cams 12A and 12B. In this connection, the follower section 14 of the rocker arm 3 is formed with two contact portions 14B, 14B which are spaced from each other and respectively contactable with the cam face of the cam 12A and the cam face of the cam 12B. It will be understood that when the rocker arm 3 is moved toward the side of the cam 13 nearly by a distance of the width of the cam 12A, 12B, 13 in the axial direction of the rocker shaft 4 so that one of the contact portions 14B, 14B is brought into contact with the cam 13, the cam 12B becomes located between the two contact portions 14B, 14B. In this regard, the cutout portion 14A is formed between the two contact portions 14B, 14B in order that the cam 12B does not obstruct an effective contact between the cam 13 and one of the contact portions 14B. As shown, the cam 12' for the exhaust valve 11 is likewise formed to have the narrower cams 12A', 12B' which are spaced from each other. The follower section 14' of a rocker arm 3' for the exhaust valve 11 is likewise formed to have two contact portions 14A', 14B'. It will be appreciated that the cams 12A, 12B, 12A' and 12B' and the rocker arm follower sections 14, 14' are constructed and arranged such that the amount of movement of the rocker arms 3, 3' becomes nearly half that in the conventional valve operation changing system as shown in FIGS. 1 to 3.

As shown in FIG. 10, the collar 15A is slidably mounted on the rocker shaft 4 and located between the rocker arm 3 and the bracket 5A, while a collar 15B is likewise mounted on the rocker shaft 4 and located between the rocker arm 3' and the bracket 5B. Additionally, a spring S is interposed between the collar 15A and the rocker arm 3 and causes the engine to operate in accordance with the cams 12, 12' when the engine is starting and therefore the hydraulic oil pressure has not yet risen sufficiently. The spring S urges the rocker arms 3, 3' toward the side of the cams 12, 12' for cylinder activation. The reference numeral 17 denotes a spacer ring.

The hydraulic pressure chamber 19A is defined by the bracket 5A, the collar 15A, the rocker shaft 4 and the rocker arm 3 as mentioned above, while a hydraulic pressure chamber 19B is defined by the bracket 5B, the collar 15B, the rocker shaft 4 and the rocker arm 3'. Pressure passages 18A, 4A communicate with the pressure chamber 19A and are formed in the bracket 5A and the rocker shaft 4, respectively. Pressure passages 18B, 4B communicate with the pressure chamber 19B and are formed in the bracket 5B and the rocker shaft 4, respectively. When these pressure chambers 19A, 19B are supplied with pressurized oil through a flow direction changing valve 23, the rocker arms 3, 3' are moved in the axial direction of the rocker shaft 4. The reference numeral 16 designates an oil seal used for the collars 15A, 15B.

An oil pump 21 functions to pressurize hydraulic oil from an oil tank 29, and so arranged that the reciprocal motion of a piston 21A of the oil pump is made by a cam 20 formed on the camshaft 6, so that the oil pump 21 discharges pressurized oil. An accumulator 22 stores or accumulates the oil from the oil pump 21 and supplies pressurized oil into the hydraulic chambers 19A, 19B through the flow direction changing valve 23, and into a pilot valve 24. It would appear in least in theory that the time duration it takes for the pressure within the pressure chamber 22B of the accumulator 22 to regain a predetermined level with the oil from the oil pump 21 after the stored oil within the pressure chamber 22B is discharged out would be crucial. However, the time duration to obtain the predetermined pressure is, for example, about 0.5 second even during engine idling (at about 600 rpm) in case where the discharge amount of the accumulator 22 is set to 5 cc and the discharge amount of the oil pump 21 is set to 1 cc per each engine revolution. Accordingly, it is justifiable in practice to consider that the accumulator 22 is always filled with the hydraulic oil having a pressure higher than a predetermined level.

The flow direction changing valve 23 is of the reciprocally movable four-port spool type and formed at its body section with a spool hole 23B of the right cylindrical shape. A spool 23C is adapted to be disposed and slidable within the spool hole 23B. Additionally, the body section of the valve 23 is provided with four annular grooves 23D which respectively communicate with a cylinder port A, a pump port P, a cylinder port B, and a tank port T as shown. The cylinder port A communicates through the oil pressure passages 18A, 4A with the hydraulic pressure chamber 19A. The cylinder port B communicates through the oil pressure passages 18B, 4B with the hydraulic pressure chamber 19B. The pump port P communicates with the pressure chamber 22B of the accumulator 22. The tank port T communicates with the oil tank 29.

The spool 23C includes spool lands 23E in slidable contact with the inner surface of the spool hole 23B, and spool rod sections 23F. One end section of the spool 23C is formed with grooves 23G, 23H with which the pawl 26A of a stopper 26 for preventing the movement of the spool 23C is engageable. Accordingly, when the spool 23C is moved under the action of an pilot pressure from the pilot valve 24, oil passages formed by the cooperation of the annular grooves 23D and the spool rod sections 23F are changed, so that the supply of oil pressure into the hydraulic pressure chambers 19A, 19B is changed.

For example, when the pilot oil pressure acts on the right side of the spool 23C to move the spool 23C to an extreme left-hand position (in the drawing) at which the pawl 26A of the stopper 26 is engaged with the groove 23G, the pressurized oil from the accumulator 22 is supplied to the hydraulic pressure chamber 19A through the pump port P, the oil passage within the spool hole 23B, and the cylinder port A. Simultaneously, the oil in the hydraulic pressure chamber 19B is restored to the oil tank 29 through the cylinder port B, the oil passage within the spool hole 23B, and the tank port T. Conversely, when the spool 23C is in an extreme right-hand position (in the drawing) at which the pawl 26A of the stopper 26 is engaged with the groove 23H, the pressurized oil from the accumulator 22 is supplied to the hydraulic pressure chamber 19B through the pump port P, the oil passage within the spool hole 23B, and the cylinder port B. Simultaneously, the oil within the pressure chamber 19A is restored to the oil tank 29 through the cylinder port A, an oil passage within the spool hole 23B, and the tank port T.

A timing lifter 25 is provided to release the stopper 26 from the grooves 23G, 23H in timed relation to the rotation of the two cams 12, 13 for the intake valve 2 (or of the two cams 12', 13' for the exhaust valve 11). The timing lifter 25 is directly supplied (not through a check valve) with the pressurized oil whose pressure is developed by the reciprocal motion of the piston 21A which is in timed relation to the cam 20 for driving the oil pump 21. As a result, the piston 25A of the timing lifter 25 makes its simple reciprocal motion in timed relation to the cam 20. When the piston 25A is lifted (moved upwardly) against the bias of a spring 25B, the engagement of the stopper pawl 26A with the groove 23G is released. It is to be noted that the biasing force of the spring 25B for urging the piston 25A downward is so set that the upward movement of the piston 25A is made under a pressure higher than the predetermined level for the accumulator 22. Furthermore, the cam 20 for the oil pump driving is formed such that the stopper releasing timing of this lifter 25 corresponds to the time point at which the intake valve 2 of either one cylinder (the No. 2 cylinder in this case) of the cylinders (the Nos. 2 and 3 cylinders) which are capable of being deactivated is closed.

The pilot valve 24 for controlling the flow direction changing valve 23 is arranged to be put into either one of positions P1 and P2 under the action of solenoid 24A, 24B which are capable of being energized by electric signals from a control circuit 30. When the solenoid 24A is energized to put the pilot valve 24 into the P1 position, the pressurized oil from the accumulator 22 is allowed to be supplied to the right side of the flow direction changing valve 23 so as to urge the spool 23C to the extreme left-hand position, thereby restoring the oil at the left side of the valve 23 into the oil tank 29. On the contrary, when the solenoid 24B is energized to move the pilot valve 24 into the P2 position, the pressurized oil from the accumulator 22 is allowed to be supplied to the left side of the flow direction changing valve 23 so as to urge the spool 23C into the extreme right-hand position, thereby restoring the oil at the right side of the valve 23 into the oil tank 29.

The control circuit 30 is adapted to receive an electric signal from an engine load sensor 31 for sensing an engine load condition, which sensor is in operative connection with an acceleration pedal 32, and to energize the solenoid 24B of the pilot valve 24 to put the pilot valve 24 into the P2 position when the engine is operated at a predetermined light load operating range. It will be understood that the reference numerals 28A, 28B and 28C denote check valves, respectively, and the reference numeral 27 a relief valve.

The manner of operation of the thus-arranged valve operation changing system will now be discussed.

During the engine operation in which all the cylinders are under the working condition, the intake and exhaust valves 2, 11 open and close in the manner as shown in FIG. 4A in accordance with the cams 12, 12'. Simultaneously, the reciprocal movement of the oil pump piston 21A is made in accordance with the cam 20 for oil pump driving, thus supplying under pressure the hydraulic oil from the oil tank 29 to the accumulator pressure chamber 22B in which the oil pressure is raised to the predetermined level. The oil having the thus raised pressure reaches both the pump port P of the direction changing valve 23 and the pilot valve 24.

In this state, since the pilot valve 24 is in the P1 position, the pilot oil pressure from the pilot valve 24 is applied to the right side of the flow direction changing valve so as to urge the spool 23C to the extreme left-hand position, so that the stopper pawl 26A engages with the groove 23G as shown in FIG. 10. In this state, the oil which reaches the pump port P is supplied to the hydraulic pressure chamber 19A through the oil passage within the spool hole 23B, the cylinder port A, and the oil pressure passages 18A, 4A, so that the rocker arms 3, 3' are urged to be located on the cams 12, 12' for cylinder working. At this time, the hydraulic pressure chamber 19B communicates with the oil tank 29 through the oil pressure passages 4B, 18B, the cylinder port B, the oil passage within the spool hole 23B, and the tank port T.

When the control circuit 30 detects that the engine is operated at the predetermined light load operating range, in accordance with the signal from the load sensor 31 in operative connection with the acceleration pedal 32, the solenoid 24B of the pilot valve 24 is energized to change the pilot valve 24 from the P1 position to the P2 position. Accordingly, the pilot oil pressure from the pilot valve 24 acts on the left side of the flow direction changing valve 23 to urge the spool 23C rightward. However, at this moment, the movement of the spool 23C is restricted by the stopper pawl 26A, so that the spool 23C remains at an urged condition.

Under this state, when the pressure within the accumulator 22 is above the predetermined level, and the engagement of the stopper pawl 26A with the groove 23G is released at the closing timing of the intake valve 2 of the No. 2 cylinder upon the upward movement of the timing lifter piston 25A which makes its reciprocal movement in timed relation to the rotation of 12A, 12B (or 12A', 12B'), the spool 23C moves rightward to the extreme righthand position. Thereafter, the pawl 26A of the stopper 26 engages with the groove 23H under the downward movement of the piston 25A, thereby preventing the movement of the spool 23C.

It will be appreciated that such movement of the spool 23C makes a change in pressurized oil supply direction, so that the pressurized oil from the accumulator 22 is supplied from the pump port P to the hydraulic pressure chamber 19B via an oil passage within the spool hole 23B, the cylinder port B, and the oil pressure passages 18B, 4B. Simultaneously, the hydraulic pressure chamber 19A communicates with the oil tank 29 through the oil pressure passages 4A, 18A, the cylinder port A, the oil passage 23I, and the tank port T. The oil supplied to the hydraulic pressure chamber 19B causes the rocker arms 3, 3' to move onto the cams 13, 13' for the cylinder deactivation, against the bias of the spring S.

Figures 11A, 11B, 11C:
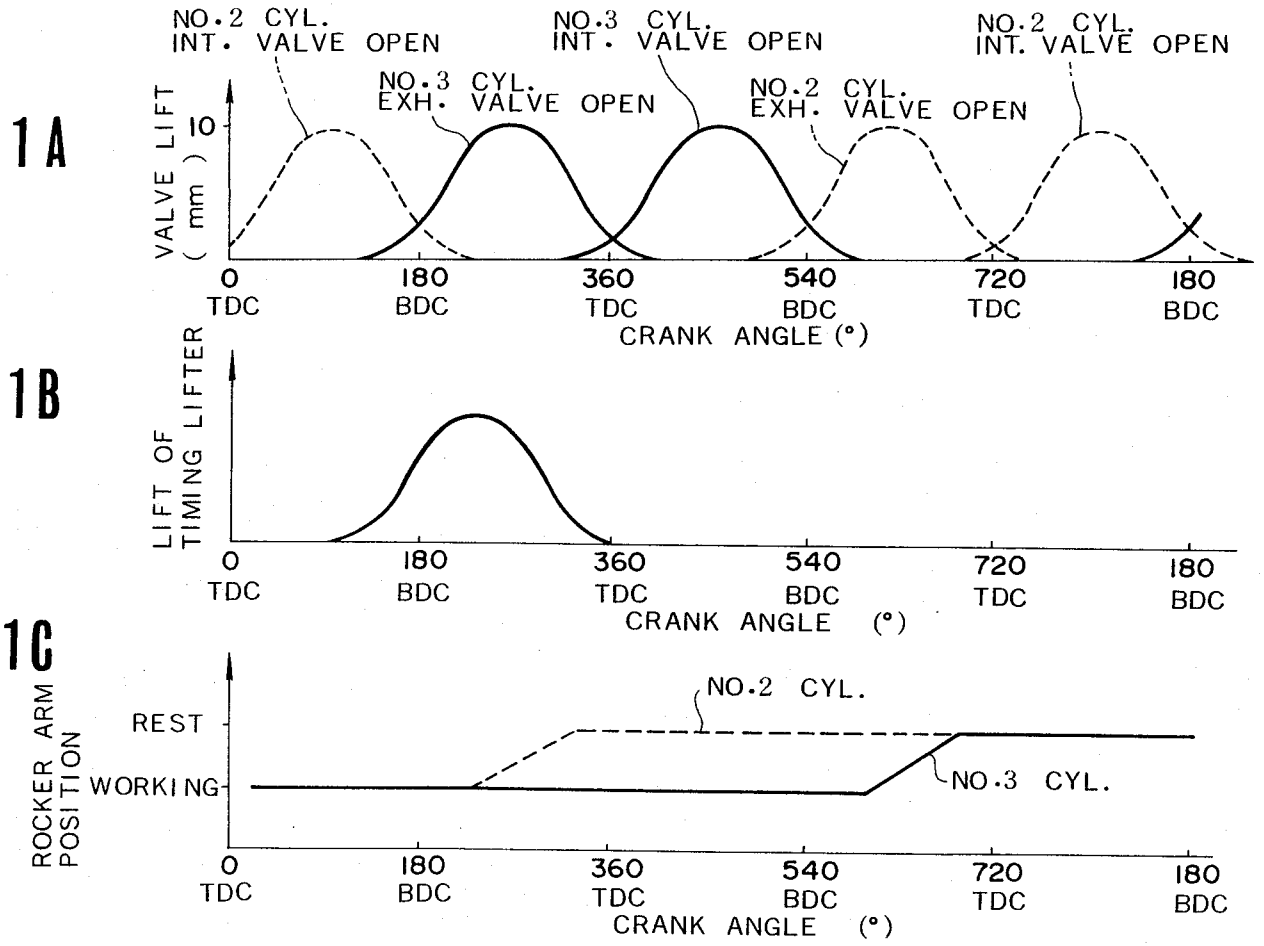
FIG. 11A is a graphical representation showing the valve timing of intake and exhaust valves of Nos. 2 and 3 cylinders during cylinder activation.
FIG. 11B is a graphical representation showing the lift of a timing lifter in relation to the valve timing of FIG. 11A.
FIG. 11C is a graphical representation showing the position of a rocker arm in relation to the valve timing of FIG. 11A.

To be concrete, the lift of the intake and exhaust valves of the cylinders (the Nos. 2 and 3 cylinders) capable of being deactivated takes place as shown in FIG. 11A, in which the timing lifter 25 makes its lift as shown in FIG. 11B so that the timing at which the engagement of the stopper 26 with the spool 23C is released by the lifter 25 corresponds to the closing time point of the intake valve 2 of the No. 2 cylinder, and therefore the intake and exhaust valves 2, 11 of the No. 2 cylinder are maintained at the fully closed state from the time point of the closing timing of the intake valve 2 until the time point at which the exhaust valve of the No. 2 cylinder begins to open. It will be understood that, at this time duration, the follower sections 14, 14' of the rocker arms 3, 3' for the No. 2 cylinder reside on the base circle area B of the cams 12, 12' for cylinder working. Consequently, the rocker arms 3, 3' are smoothly moved from the position of cylinder activation or working to the position of cylinder deactivation or rest as indicated by a broken line in FIG. 11C since the time point at which the intake valve 2 of the No. 2 cylinder is closed, under the driving force of the pressurized oil from the accumulator 22.

At this time point, the intake and exhaust valves 2, 11 of the No. 3 cylinder are lifting under the action of the cams 12, 12' for cylinder working, and accordingly the rocker arms 3, 3' for the No. 3 cylinder have not yet been moved and stand ready so as to move to the position of cylinder deactivation or rest as indicated by a solid line in FIG. 11C upon closing of the intake valve 2 of the No. 3 cylinder.

After the rocker arms 3, 3' of the Nos. 2 and 3 cylinders are moved to the position of cylinder rest, the intake valves 2 operate to open briefly at the intake stroke of the piston (in the vicinity of bottom dead center) in accordance with the cam 13 for cylinder deactivation or rest, while the exhaust valve 11 is maintained fully closed in accordance with the cam 13' for cylinder deactivation or rest (See FIG. 4B), thus achieving so-called partial-cylinder operation in which some of all the cylinders are maintained at the deactivated or rest state.

With the thus-arranged valve operation changing system, the movement amount or distance of the rocker arms 3, 3' becomes approximately half that in the conventional corresponding system as shown in FIGS. 1 to 3. Additionally, the movement of the rocker arms 3, 3' is smoothly carried out by virtue of employing hydraulic oil pressure which can provide a sufficient moving speed of the rocker arms 3, 3' even during a high speed driving. Furthermore, the movement of the rocker arms 3, 3' is in timed relation to the rotation of the cams 12, 13 (12', 13') so that the rocker arms 3, 3' are moved during the time period at which both the intake and exhaust valves are fully closed, i.e., from the closing timing of the intake valve 2 to the opening timing of the exhaust valve 11, thus regulating the moving timing of the rocker arms 3, 3'. Accordingly, the rocker arm follower sections 14, 14' and/or cams 12, 13 are effectively prevented from being damaged due to the fact that the valve lift is initiated in the state where the rocker arms have not yet reached a position at which the follower sections 14, 14' are brought into sufficient contact with the cams, excessively increasing the pressure applied per unit area at the contact faces of the rocker arm follower section and the cams.

Figure 12:
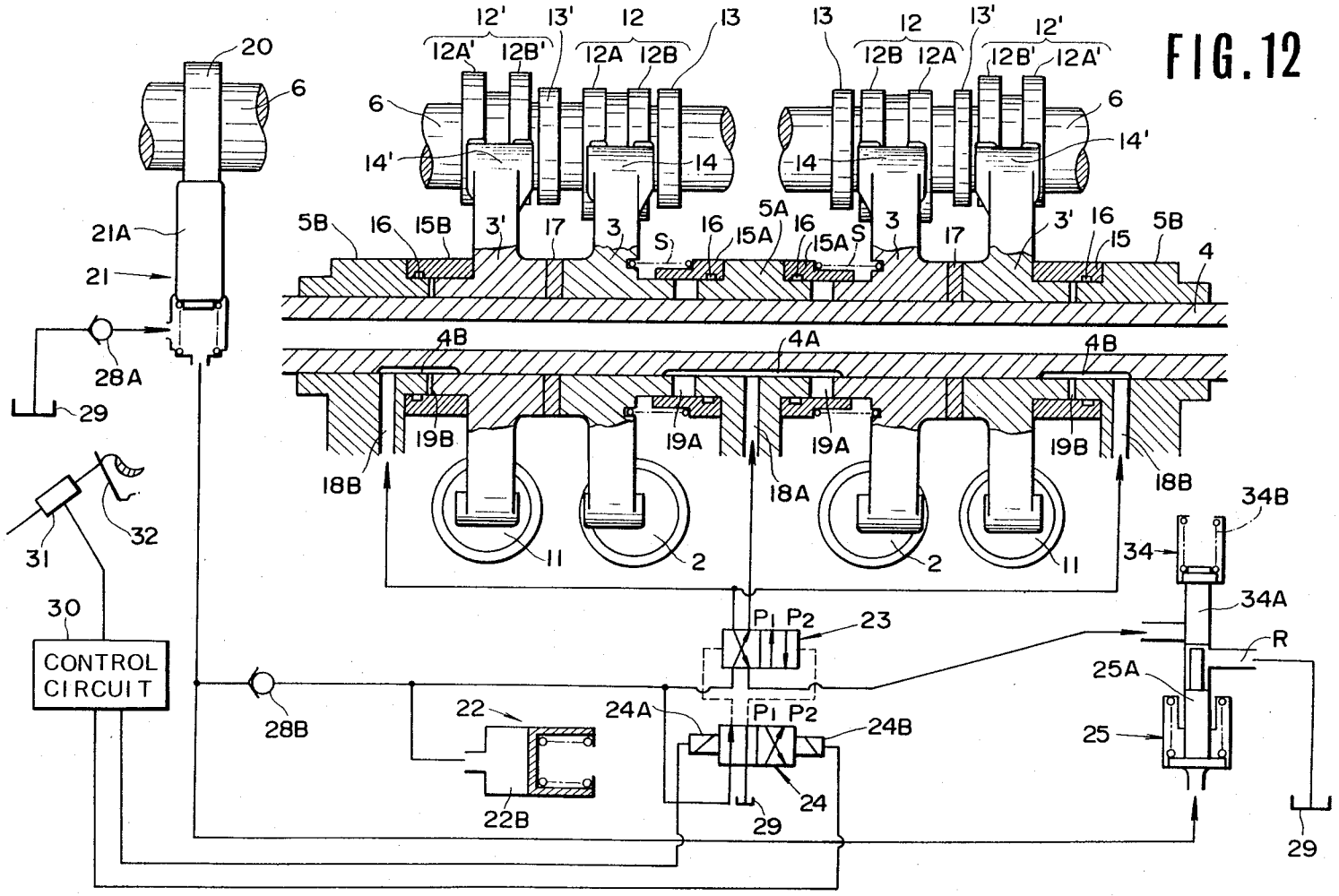
FIG. 12 is a diagram of a modified example of the second embodiment of the system in accordance with the present invention.

FIG. 12 shows a modified example of the second embodiment of the valve operation changing system in accordance with the present invention, in which the restriction of the operation of the flow direction changing valve 23 is made by a stopper valve 34 operatively disposed in an oil restoring passage R communicated with the flow direction changing valve 23, thereby restricting the flow of the oil restored through the restoring passage R to the oil tank 29.

The stopper valve 34 has a piston 34A which is usually urged downward in the drawing by a spring 34B thereby to block the oil restoring passage R. The timing lifter 25 has a piston 25A whose reciprocal motion is made in timed relation to the rotation of the cams 12, 13 (12', 13'). The timing lifter 25 is so arranged that the piston 25A causes the piston 34A of the stopper valve 34 to move upwardly so as to release the block of the oil restoring passage R. Thus, valve 23 is in fluid communication with oil tank 29 only when piston 25A pushes stopper valve 34 out of the position in which the latter blocks oil passage R. In the unblocked position, oil flows freely between valve 23 and oil tank 29 through passage R until spring 34B again causes stopper valve 34 to assume its blocking position.

The flow direction changing valve 23 is capable of being put into the P1 position or the P2 position. The P1 position corresponds to the extreme left-hand position of the spool 23C of the flow direction changing valve 23 in FIG. 10, while the P2 position corresponds to the extreme right-hand position of the same.

In this case, when the control circuit 30 detects an engine operation at the predetermined light load operating range, the pilot valve 24 is changed from its P1 position to its P2 position, so that the flow direction changing valve 23 is changed from the P1 position to the P2 position. By this changing in the flow direction changing valve 23, the pressurized oil from the accumulator 22 is fed to the hydraulic pressure chamber 19B so as to move the rocker arms 3, 3' onto the cams 13, 13'. However, at this moment, the oil restoring passage R leading to the hydraulic pressure chamber 19A is blocked by the stopper valve 34, and therefore the rocker arms 3, 3' remain biased without being moved.

In this state, at the time point at which the intake valve 2 of the No. 2 cylinder is closed upon the upward movement of the stopper valve piston 34A under the action of timing lifter piston 25A, the block of the oil restoring passage R is released. Thereafter, the valve operation changing system in this case operates as same as that in FIG. 10, so that the rocker arms 3, 3' are smoothly transferred to the respective positions for cylinder deactivation or rest as shown in FIG. 11C. It is to be noted that since the oil pressure in the oil restoring passage R is raised during the transfer of the rocker arms 3, 3' from the cylinder working state to the cylinder rest state, the stopper valve 34 is kept opened to effectively complete the transfer of the rocker arms for the Nos. 2 and 3 cylinders. After the pressure in passage R drops, spring 34B is sufficient to return stopper valve 34 to its blocking position.

As will be appreciated from the above, according to the embodiments of FIGS. 10 and 12, the oil pump in cooperation with the accumulator provides a greater drive speed of the rocker arms which speed corresponds to that by a large-sized (volume) oil pump. Since the transfer of the rocker arms is carried out for the time period at which both the intake and exhaust valves are fully closed, the reliability of valve operation changing and the durability of the parts of the system are greatly improved. Furthermore, the reciprocal motion of the timing lifter piston is in timed relation to that of the oil pump piston, and therefore the oil discharge amount of the oil pump becomes substantially zero, thereby resulting in the fact that it is sufficient that the oil pump functions only to supplement the hydraulic oil leaking from the various parts of the system. This sharply reduces the consumed power required for driving the oil pump.

Figure 13:
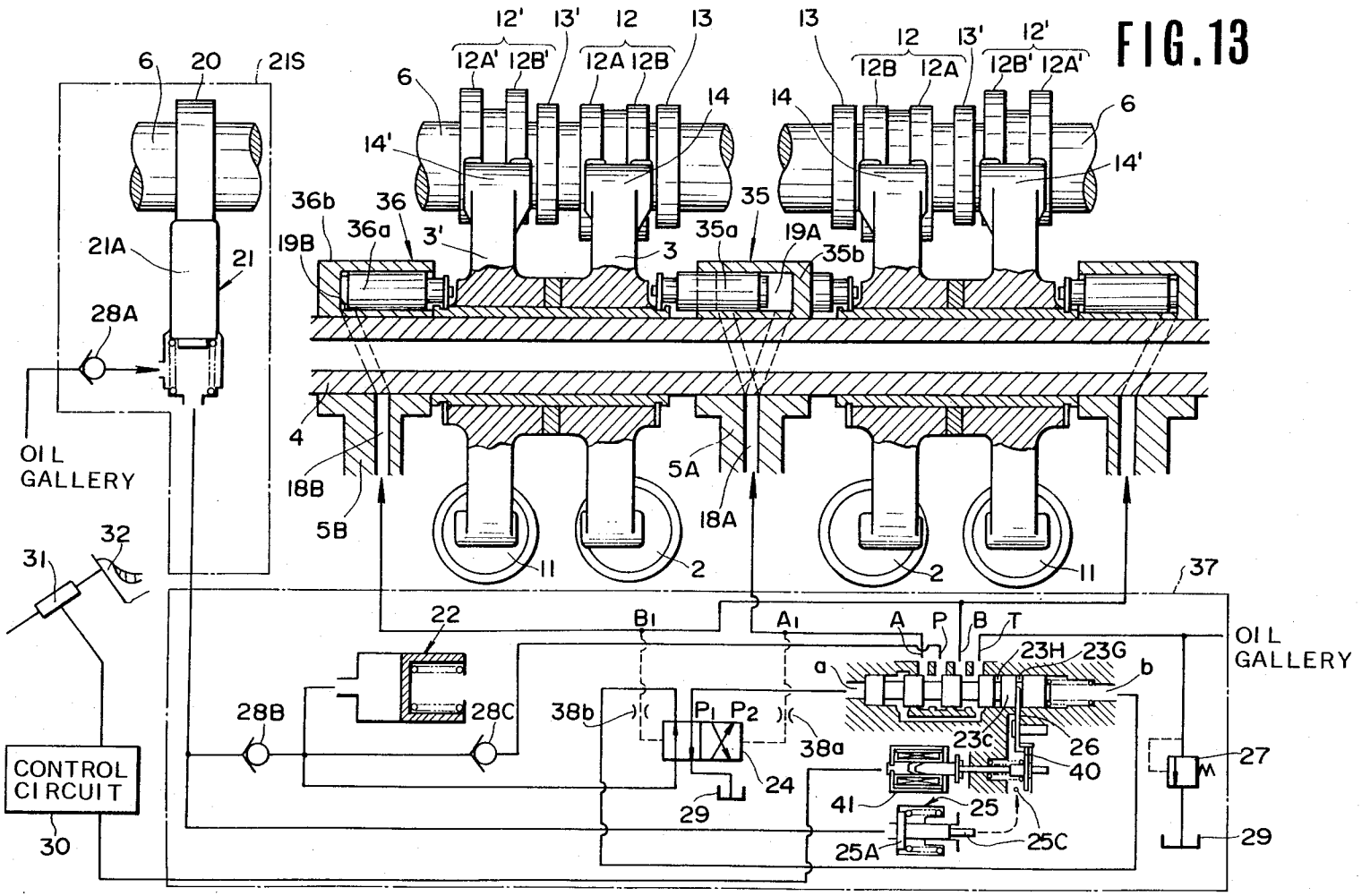
FIG. 13 is a diagram of a third embodiment of the valve operation changing system in accordance with the present invention.
Figure 14:
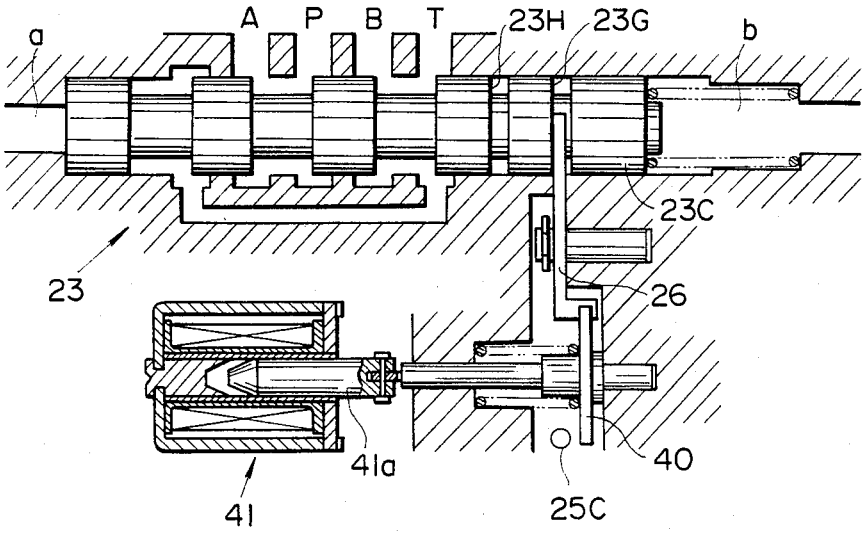
FIG. 14 is an enlarged view of an essential part of FIG. 13.
Figure 15:
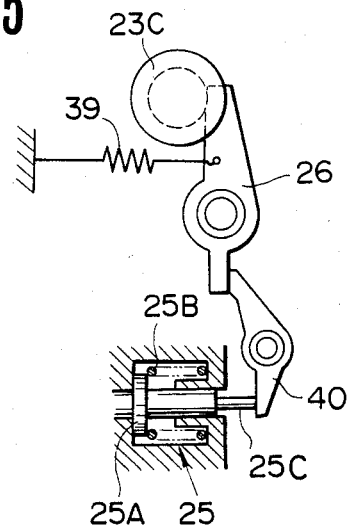
FIG. 15 is a side view of the part shown in FIG. 14.

FIGS. 13 to 15 illustrate a third embodiment of the valve operation changing system in accordance with the present invention, which is similar to the second embodiment except in the means for the driving the rocker shaft 3, 3' and means for restricting the operation of the flow direction changing valve 23.

In this embodiment, the brackets 5A and 5B are integrally formed respectively with hydraulic actuators 35, 36. The actuator 35 includes a piston **35*a* which is movably disposed within a cylinder 35*b*, defining therebetween the hydraulic pressure chamber 19A which is filled with the oil through the pressure passage 18A. Likewise, the actuator 36 includes a piston 36*a* which is movably disposed within a cylinder 36*b*, defining therebetween the hydraulic pressure chamber 19B. It will be understood that the piston 35*a* and 36*a* move so as to project from the cylinders 35*b*, 36*b*, respectively, thus selectively locating the rocker arm 3, (3') onto one of the cam 12 (12') for cylinder activation or working and the cam 13 (13') for cylinder deactivation or rest. Though not shown, a spring is interposed between the bracket 5A and the rocker arm 14 to urge the rocker arms to be located on the cams 12, 2'** for causing all of the cylinders to work even when the engine is started and the oil pressure has not yet risen sufficiently.

The oil pump 21 forming part of an oil pump section 21S is arranged to pressurize the oil from an oil gallery and supply it into a hydraulic pressure control section 37 including the accumulator 22, the flow direction control valve 23, and the pilot valve 24. The oil gallery leads to the oil tank 29. The pilot valve 24 is so arranged to receive an oil pressure A1 developed between the port A of the flow direction changing valve 23 and the hydraulic pressure chamber 19A, and an oil pressure B1 developed between the port B of the valve 23 and the hydraulic pressure chamber 19B. It will be understood that the pilot valve 24 takes the P1 position or the P2 position in accordance with the magnitude relation between the oil pressure A1 introduced through a throttled portion or orifice 38*a* and the oil pressure B1 introduced through a throttled portion or orifice 38*b*, thereby supplying the oil pressure from the accumulator 22 into either one of side chambers a, b which are located at the opposite sides of the flow direction changing valve spool 23C, the remaining side chamber being connected to the oil tank 29 to restore the oil thereinto. Thus, the oil pressures A1, B1 varied by the position change of the flow direction changing valve spool 23C causes the pilot valve 24 to operate in a manner to restore the spool 23C to the initial position.

In this embodiment, the stopper 26 is engageable with either one of the annular grooves 23G, 23H of the spool 23C so as to lock the spool 23C at one of two positions. The stopper 26 is usually urged to engage with the groove 23G, 23H under the bias of a spring 39 as shown in FIG. 15. The engagement of the stopper 26 with the groove 23G, 23H is released by rotating the stopper 26 in the direction opposite to the urging direction of the spring 39. Such rotation of the stopper 26 is made by rotating an arm 40 counterclockwise in FIG. 15 upon engagement with a projectable rod 25C of the timing lifter 25. It is to be noted that the engagement of the arm 40 and the timing lifter rod 25C is made only when an electromagnetic actuator 41 is in its attracting state in which a movable rod 41*a* moves leftward in FIG. 14. As seen from FIG. 14, the leftward movement of the actuator rod 41*a* causes the arm 40 to be engaged with the timing lifter projectable rod 25C. The projectable rod 25C of the timing lifter 25 is connected to the piston 25A which directly receives the oil pressure from the oil pump 21, so that the rod 25C makes its reciprocal motion in timed relation to the reciprocal motion of the oil pump piston 21A or the rotation of the cams 12, 12'.

The electromagnetic actuator 41 is arranged to be energized a predetermined time period to attract the rod 41*a* leftward in FIG. 14 when the engine operation is changed from a predetermined high engine load range to a predetermined low engine load range, or from the predetermined low engine load range to the predetermined high engine load range. This energization of the electromagnetic actuator 41 is accomplished by the control circuit 30 which receives a signal from the engine load or acceleration sensor 31, which in turn senses the depression amount of the acceleration pedal 32.

With the thus-arranged valve operation changing system of FIGS. 13 to 15, when all the cylinders are in the activated or working state, the spool 23C of the flow direction changing valve 23 is in the position shown in FIGS. 13 and 14, so that the hydraulic oil pressure is introduced into the hydraulic pressure chamber 19A. As a result, the rocker arms 3, 3' are driven by the cams 12, 12' for cylinder working as shown in FIG. 13. In this state, the oil pressure A1 applied to the pilot valve 24 is greater than the oil pressure B1 applied to the pilot valve 24, and accordingly the pilot valve 24 is put into the P2 position so as to cause the oil pressure to be applied to the chamber a of the flow direction changing valve 23. Note that this is in contrast to the previously-described embodiments in which pilot valve 24 was a solenoid valve controlled directly by control circuit 30. In the present embodiment, however, pilot valve 24 is a pressure-operated valve which changes state prior to an actual change in valve operation. Pilot valve 24 would allow spool 23C of the flow direction changing valve 23 to be moved to the position opposite to the position shown in the drawing, except that, such movement of the spool 23C is obstructed by the stopper 26.

From this state, when the control circuit 30 detects a predetermined reduction of engine load in accordance with an output variation of the acceleration sensor 31, the electromagnetic actuator 41 is energized the predetermined time period to move the arm 40 leftward in FIG. 14. Accordingly, the rod 25C of the timing lifter 25 and the arm 40 are put into the state where they can engage with each other. Now, the rod 25C of the timing lifter 25 makes its reciprocal motion in timed relation to the lift of the cams 12, 12', to be projected so as to rotate the stopper 26 through the arm 40, thus releasing the engagement of the stopper 26 with the spool 23C in the vicinity of bottom dead center. Such engagement release at the predetermined timing is accomplished by suitably setting the phase of the cam 20 for driving the oil pump 21. When the engagement of the stopper 26 is released, the spool 23C of the flow direction changing valve 23 is moved rightward in FIG. 13 and locked in this state where the stopper 26 engages with the groove 23H of the spool 23C. This is because the lift of the timing lifter 25 is not made until the accumulator 22 is again filled with the oil, in which the electromagnetic actuator 41 is again deenergized.

Figure 16:
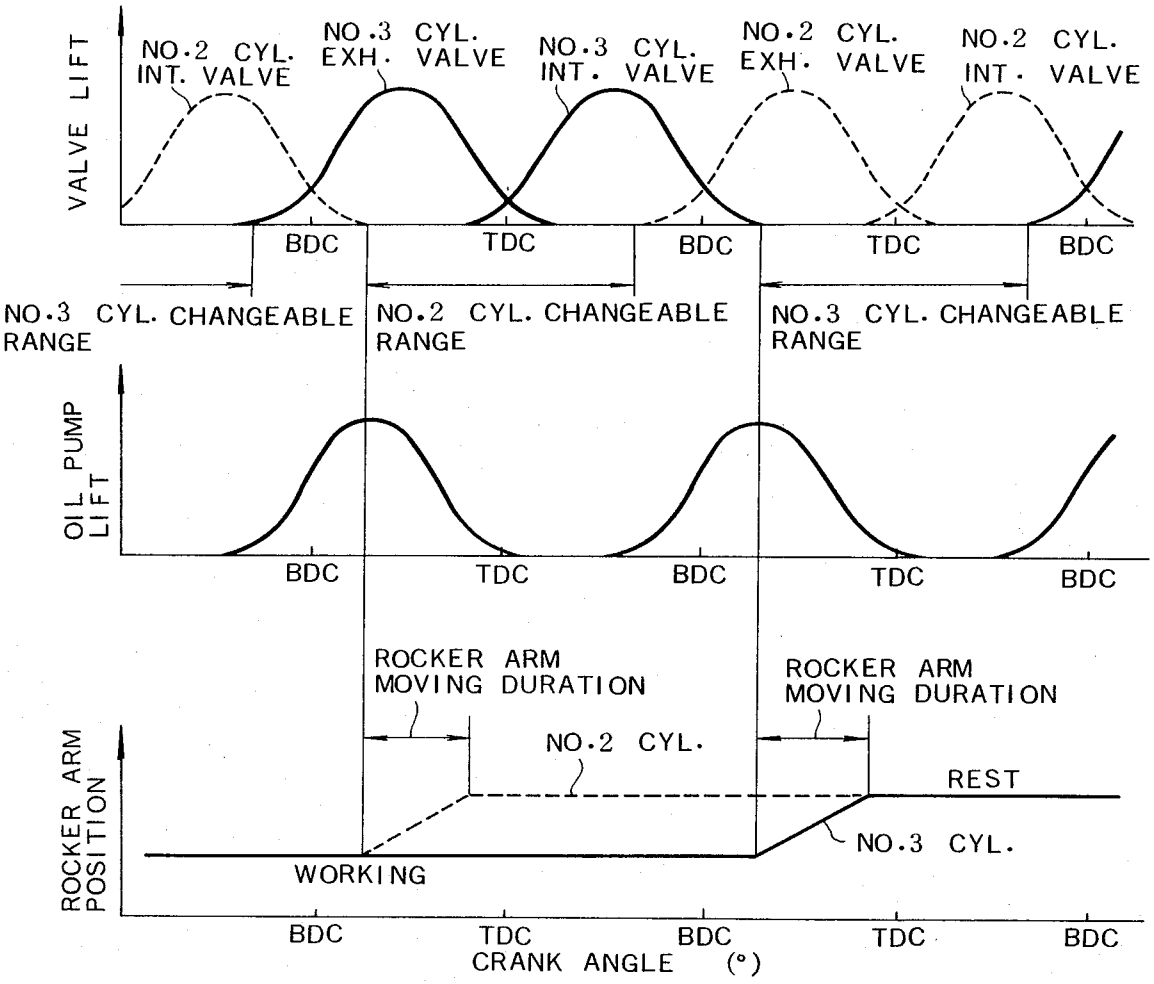
FIG. 16 is a graphical representation showing the timing of the movement of rocker arms.

Under this changed condition of the flow direction changing valve 23, the oil pressure from the accumulator 22 is supplied to the hydraulic pressure chamber 19B, while the oil pressure within the hydraulic pressure chamber 19A is discharged. Now, referring to FIG. 16, when the usual lift of the intake valve 2 in the No. 2 cylinder is terminated after bottom dead center, a clearance is made between the contacting surfaces of the rocker arms 3, 3' and the cams 12, 12', so that the rocker arms 3, 3' are moved at a stretch onto the cams 13, 13', respectively. Then, the usual lift of the exhaust valve 11 of the No. 3 cylinder has already been initiated before bottom dead center. In this state, even when the spool 23C of the flow direction changing valve 23 is moved, the rocker arms 3, 3' do not move axially until the succeeding lift of the intake valve 2 is terminated. Because at least one of the cams 12, 12' is driving the rocker arms 3, 3', a considerable frictional force is developed between the contact surfaces of the rocker arms 3, 3' and the cams 12, 12' under the bias of the valve spring (not shown). When a clearance is made between the contact surfaces of the rocker arms 3, 3' and the cams 12, 12' at the time point where the usual lift of the intake valve 2 has been terminated, the rocker arms 3, 3' for the No. 3 cylinder are moved at a stretch onto the cams 13, 13' for cylinder deactivation or rest, thereby completing the valve operation changing action as shown in FIG. 16.

Additionally, when the position of the spool 23C of the flow direction changing valve 23 is changed, the magnitude of the oil pressures A1, B1 is reversed to change the positions P1, P2 of the pilot valve 24, the oil pressure from the pilot valve 24 acts on the flow direction changing valve 23 in a manner to restore the spool 23C to the initial position. However, the spool 23C of the flow direction changing valve 23 is locked, and therefore the position of the spool 23C is actually not changed so as to stand ready for the next position change. Thus, by previously changing signal oil pressures to the flow direction changing valve 23, the position change of the flow direction changing valve spool 23C takes place at a stretch when the engagement of the stopper 26 is released in the valve operation change, thereby improving the response in the valve operation change.

While the cam 12 (12') and the cam 13 (13') have been shown and described as being formed to be suitable for activating and for deactivating cylinder, respectively, it will be understood that the cam 12 (12') and the cam 13 (13') may be, for example, so formed as to be suitable for a high engine speed operation and for a low engine speed operation, respectively. In accordance with the cams for the high engine speed operation, the valve overlap of intake and exhaust valves will be increased thereby to improve the charging efficiency of intake air at a high engine speed operating range. In accordance with the cams for the low engine speed operation, the valve overlap will be decreased to prevent exhaust gas backward flow to the cylinder in the state where a throttle valve opening degree is smaller, thereby improving the charging efficiency of intake air even at a low engine speed operating range.

It will be clearly understood from the above, that the present invention is applicable to a variety of engines other than dual-mode engines in which some of cylinders are deactivated in accordance with engine operating conditions.

Having described the present invention as related to the embodiments shown in the accompanying drawings, it is intended that the invention be not limited by any of the details of description, unless otherwise specified, but rather be constructed broadly within its spirit and scope as set out in the accompanying claims.

What is claimed is:

1. A valve operation changing system of an internal combustion engine, comprising:

first and second cams formed on a camshaft, said first and second cams being different in cam profile from each other, at least said first cam having a plurality of cam faces, said plurality of cam faces of said first cam being so axially separate from each other that a cam face of said second cam is locatable therebetween;

a rocker arm mounted on a rocker shaft and swingable relative to the rocker shaft so as to operate an engine valve, said rocker arm being formed with a follower section which has a plurality of contact faces contactable with said cam faces, said rocker arm being movable in the axial direction of said rocker shaft between a first position in which at least one of said plurality of contact faces of said follower section is brought into contact with one of said plurality of cam faces of said first cam and a second position in which at least one of said plurality of contact faces of said follower section is brought into contact with the cam face of said second cam; and means for selectively placing said rocker arm in one of said first and second positions in accordance with an engine operating condition.

2. A valve operation changing system as claimed in claim 1, wherein said first cam has, a cam profile suitable for a first valve timing of the engine valve, and said second cam has a cam profile suitable for a second valve timing of said engine valve, the first valve timing being different from the second valve timing.

3. A valve operation changing system as claimed in claim 2, wherein said plurality of cam faces are the same in cam profile.

4. A valve operation changing system as claimed in claim 3, wherein one of the cam faces of said first cam and the cam face of said second cam are located side by side.

5. A valve operation changing system as claimed in claim 4, wherein each of said first and second cams has two cam faces, and wherein said plurality of contact faces of said rocker arm follower section consists of two contact faces.

6. A valve operation changing system as claimed in claim 5, wherein said rocker arm follower section is formed with first and second contact portions which are arranged in parallel relationship with and spaced from each other, defining therebetween a cutout portion, said first and second contact portions having respectively said two contact faces, and wherein said first cam includes first and second narrower cams which have respectively said two cam faces, one of said first and second narrower cams being locatable within said cutout portion.

7. A valve operation changing system as claimed in claim 1, wherein said rocker arm placing means includes:

an oil pump driven in timed relation with the revolution of the engine to pressurize hydraulic oil;

an oil accumulator fluidly connected to said oil pump to accumulate the pressurized oil from said oil pump;

a flow direction changing valve fluidly connected to said accumulator and arranged to selectively take one of first and second states;

means defining first and second hydraulic pressure chambers which are fluidly connectable with said accumulator through said changing valve, said first hydraulic pressure chamber being suppliable with the oil from said accumulator to put said rocker arm into the first position when said changing valve is in the first state, said second hydraulic pressure chamber being suppliable with the oil from said accumulator to put said rocker arm into the second position when said changing valve is in the second state;

means for selectively putting said changing valve into one of the first and second states in accordance with the engine operating condition;

stopper means for restricting the operation of said changing valve; and means for releasing the restriction action of said stopper means in timed relation to the rotation of said first and second cams, whereby the movement of said rocker arms between the first and second positions takes place in timed relation to the rotation of said first and second cams.

8. A valve operation changing system as claimed in claim 7, wherein said flow direction changing valve includes a movable valve member which is locatable at one of first and second positions corresponding respectively to the first and second states of said changing valve.

9. A valve operation changing system as claimed in claim 8, wherein said changing valve putting means includes a pilot valve which alternately assumes one of first and second states for causing said changing valve movable valve member to be located in one of the first and second positions, respectively, and a control circuit for selectively putting said pilot valve into one of the first and second states in accordance with the engine operating condition.

10. A valve operation changing system as claimed in claim 9, wherein said oil pump includes a piston which is reciprocally movable in timed relation to a drive cam formed on said cam shaft on which said first and second cams are formed, the reciprocal motion of said piston pressurizing the oil.

11. A valve operation changing system as claimed in claim 10, wherein said stopper means includes a stopper member which is engageable with said movable valve member of said changing valve to stop the movement of said movable valve member.

12. A valve operation changing system as claimed in claim 11, wherein said releasing means includes a timing lifter directly fluidly connected to said oil pump and operated in timed relation to the rotation of said drive cam, said timing lifter being arranged to release the engagement of said stopper member with said valve member of said flow direction changing valve.

13. A valve operation changing system as claimed in claim 12, further comprising means for causing said valve member of said flow direction changing valve to move according to the pressure of the oil from said accumulator through said pilot valve.

14. A valve operation changing system as claimed in claim 10, wherein said stopper means includes a stopper valve disposed in an oil restoring passage through which said first and second hydraulic pressure chambers are communicable with an oil tank, said stopper valve being arranged to block said oil restoring passage.

15. A valve operation changing system as claimed in claim 14, wherein said releasing means includes a timing lifter directly fluidly connected to said oil pump and operated in timed relation to the rotation of said drive cam, said timing lifter being arranged to release the blocking action of said stopper valve.

16. A valve operation changing system as claimed in claim 7, wherein said first and second cams operate an intake valve, and wherein said system further comprises third and fourth cams being formed on said camshaft on which said first and second cams are formed, and different in cam profile from each other, at least one of said cams having a plurality of cam faces which are separate from each other.

17. A valve operation changing system as claimed in claim 16, further comprising another rocker arm contactable with said third and fourth cams and mounted on said rocker shaft on which said rocker arm contactable with said first and second cams is mounted, said rocker arms being located side by side to be moved simultaneously with each other in the axial direction of said rocker shaft.

18. A valve operation changing system of an internal combustion engine, comprising:

first and second cams formed on a camshaft, said cams having mutually different cam profiles, said first cam having at least two first cam faces axially separated from one another, and said second cam having at least one second cam face axially adjacent at least one of said at least two axially separated first cam faces;

a rocker arm mounted on a rocker shaft and pivotable thereabout so as to operate an engine valve, said rocker arm having a follower section axially divided into at least two contact faces, and said rocker arm further being axially shiftable along said rocker shaft between a first position in which at least one of said contact faces contacts one of the first cam faces, and a second position in which one of said contact faces contacts said second cam face; and means for alternately and selectively shifting said rocker arm between said first position and said second position in accordance with an operating condition of said engine.

19. A valve operation changing system as claimed in claim 18 wherein said second cam face is axially interposed between and axially adjacent both of said first cam faces.

* * * * *